US010455858B2

(12) United States Patent
Deforel et al.

(10) Patent No.: US 10,455,858 B2
(45) Date of Patent: Oct. 29, 2019

(54) HOMOGENIZED TOBACCO MATERIAL WITH MELTABLE LIPID

(71) Applicant: Philip Morris Products S.A., Neuchatel (CH)

(72) Inventors: Corinne Deforel, Formangueires (CH); Marine Jarriault, Bern (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/772,161

(22) PCT Filed: Nov. 7, 2016

(86) PCT No.: PCT/EP2016/076851
§ 371 (c)(1),
(2) Date: Apr. 30, 2018

(87) PCT Pub. No.: WO2017/077112
PCT Pub. Date: May 11, 2017

(65) Prior Publication Data

US 2018/0310609 A1 Nov. 1, 2018

(30) Foreign Application Priority Data

Nov. 5, 2015 (EP) ..... 15193299

(51) Int. Cl.
*A24B 15/16* (2006.01)
*A24B 15/12* (2006.01)
(Continued)

(52) U.S. Cl.
CPC ..... *A24B 15/167* (2016.11); *A24B 15/12* (2013.01); *A24B 15/14* (2013.01); *A24B 15/30* (2013.01); *A24B 15/32* (2013.01)

(58) Field of Classification Search
None
See application file for complete search history.

(56) References Cited

U.S. PATENT DOCUMENTS 4,144,894 A 3/1979 Schmidt et al.
8,695,698 B2 4/2014 Noel
(Continued)

FOREIGN PATENT DOCUMENTS

CN 101272703 A 9/2008
CN 102920015 A 2/2013
(Continued)

OTHER PUBLICATIONS

Notification of Transmittal of the International Preliminary Report on Patentability, dated Oct. 13, 2017 in International Application No. PCT/EP2016/076851 (6 pages).
(Continued)

*Primary Examiner* — Michael J Felton
*Assistant Examiner* — Katherine A Will
(74) *Attorney, Agent, or Firm* — Oblon, McClelland, Maier & Neustadt, L.L.P.

(57) ABSTRACT

There is provided a heated aerosol-generating article for producing an inhalable aerosol, the article including an aerosol-forming substrate that is a homogenized tobacco material including tobacco and a wax having a melting point between 50° C. and 150° C., a total content of wax in the homogenized tobacco material being between 5 weight percent and 15 weight percent on a dry weight basis, and the wax being evenly distributed within the homogenized tobacco material. A homogenized tobacco material and a method of making a homogenized tobacco material are also provided.

13 Claims, 1 Drawing Sheet

(51) Int. Cl.

| | |
|---|---|
| ***A24B 15/14*** | (2006.01) |
| ***A24B 15/30*** | (2006.01) |
| ***A24B 15/32*** | (2006.01) |

(56) References Cited

U.S. PATENT DOCUMENTS

| | | | | |
|---|---|---|---|---|
| 2005/0016549 | A1 | 1/2005 | Banerjee et al. | |
| 2012/0118310 | A1 | 5/2012 | Cantrell et al. | |
| 2015/0313285 | A1 | 11/2015 | Waller et al. | |
| 2016/0213063 | A1 | 7/2016 | Ajithkumar et al. | |
| 2016/0324209 | A1* | 11/2016 | Hufnagel | A24B 15/283 |
| 2017/0273346 | A1* | 9/2017 | Klipfel | A24B 3/14 |

FOREIGN PATENT DOCUMENTS

| | | | |
|---|---|---|---|
| CN | 104822281 | A | 8/2015 |
| EA | 201290809 | A1 | 2/2013 |
| EP | 2 885 983 | A1 | 6/2015 |
| JP | 54-41397 | A | 4/1979 |
| JP | 2013-541324 | | 11/2013 |
| JP | 2015-502175 | | 1/2015 |
| RU | 8499890 | A4 | 7/1981 |
| WO | WO 2015/055567 | A1 | 4/2015 |
| WO | WO 2015/092748 | A1 | 6/2015 |

OTHER PUBLICATIONS

International Search Report and Written Opinion dated Jan. 24, 2017 in PCT/EP2016/076851 filed Nov. 7, 2016.

Combine Russian Federation Office Action and Search Report dated Feb. 28, 2019 in Patent Application No. 2018120179/12(031765) (with partial English translation and English translation of categories of cited documents), 16 pages.

Decision to Grant dated Oct, 15, 2018 in Japanese Patent Application No. 2018-519952 (with English translation), 6 pages.

Combined Chinese Office Action and Search Report dated Mar. 13, 2019 in corresponding Chinese Patent Application No. 201680059380.3 (with English Translation), 14 pages.

Korean Notice of Allowance with English translation dated Jul. 29, 2019 in corresponding Korean Patent Application No. 2018-7010317, citing documents AO and AP therein (3 pages).

* cited by examiner

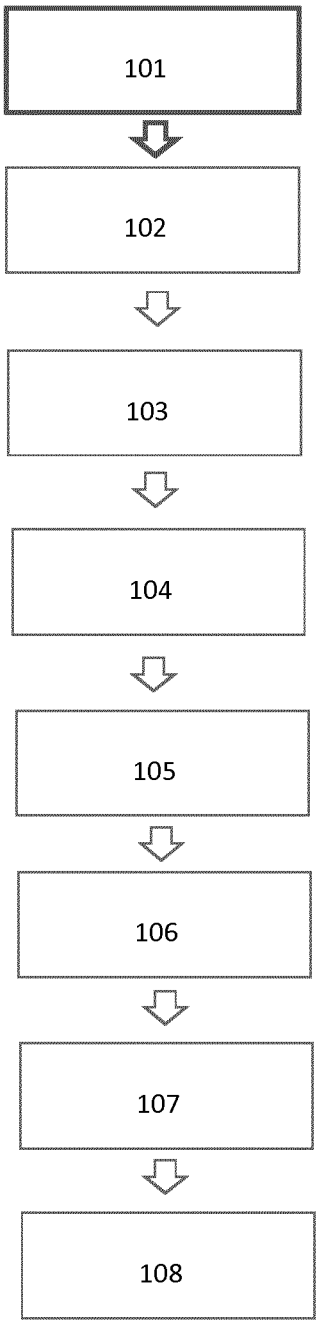
101
102
103
104
105
106
107
108

HOMOGENIZED TOBACCO MATERIAL WITH MELTABLE LIPID

This invention relates to a heated aerosol-generating article and homogenized tobacco material for use in such an article. In particular, the invention relates to a homogenized tobacco material having a meltable lipid component for improved transfer of volatile components. The homogenized tobacco material is suitable for use in a heated aerosol-generating article such as, for example, a "heat-not-burn" type smoking article.

Homogenized tobacco material is frequently used in the production of tobacco products. This homogenized tobacco material is typically manufactured from parts of the tobacco plant that are less suited for the production of cut filler, like, for example, tobacco stems or tobacco dust.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web. For example, a tobacco web may be formed by casting a viscous slurry onto a moving metal belt to produce so called cast leaf. Alternatively, a slurry with low viscosity and high water content can be used to create reconstituted tobacco in a process that resembles paper-making.

In a heated aerosol-generating article, an aerosol-forming substrate is heated to a relatively low temperature, for example about 350° centigrade, in order to form an inhalable aerosol. In order that an aerosol may be formed, the homogenized tobacco material preferably comprises high proportions of aerosol-formers and humectants, such as glycerine or propylene glycol. The homogenized tobacco material also contains nicotine. Rods formed from homogenized tobacco material that are suitable for use as aerosol-forming substrates in heated aerosol-generating articles are disclosed in WO2012164009.

To create an aerosol, aerosol-formers must be released from the homogenized tobacco material. In order to be released, these aerosol-formers must migrate from within the body of the homogenized tobacco material to surfaces of the homogenized tobacco material. Other volatile compounds, such as nicotine, must also migrate from within the body of the homogenized tobacco material to become entrained in the aerosol. It may be desirable to improve the efficiency and rate at which aerosol-formers are released from a homogenized tobacco material on heating.

The migration of aerosol-formers and other volatile compounds within a homogenized tobacco material is limited by diffusion. One way to improve the efficiency and rate at which aerosol-formers are released may be to increase the temperature that the homogenized tobacco material is heated to, thereby improving diffusion. This may be undesirable, however, as an increase in temperature may result in the evolution of undesirable compounds. An increase in temperature may also adversely affect physical properties of the aerosol that is formed, for example temperature of the aerosol or droplet size of the aerosol.

Another way to improve the efficiency and rate at which aerosol-formers and other volatile compounds are released on heating may be to increase the amount of surface area per unit volume of homogenized tobacco material. This may necessitate the use of thin sheets of homogenized tobacco material. Homogenized tobacco material lacks strength, however, due to a high concentration of aerosol-formers.

Thin sheets of homogenised tobacco material are extremely difficult to handle and process.

In a first aspect, a heated aerosol-generating article for producing an inhalable aerosol is provided. The heated aerosol-generating article comprises an aerosol-forming substrate. The aerosol-forming substrate is a homogenized tobacco material comprising tobacco and a lipid having a melting point between 50° C. and 150° C. The total content of lipid in the homogenized tobacco material is between 5 weight percent and 15 weight percent on a dry weight basis, and the lipid is evenly distributed within the homogenized tobacco material. The lipid is a wax.

In a further aspect, a homogenized tobacco material may be provided, the homogenized tobacco material comprising tobacco and a lipid having a melting point between 50° C. and 150° C. The total content of lipid in the homogenized tobacco material is between 5 weight percent and 15 weight percent on a dry weight basis, and the lipid is evenly distributed within the homogenized tobacco material. The lipid is a wax.

The term "homogenized tobacco material" is used throughout the specification to encompass any tobacco material formed by the agglomeration of particles of tobacco material. Sheets or webs of homogenized tobacco are formed by agglomerating particulate tobacco obtained by grinding or otherwise powdering of one or both of tobacco leaf lamina and tobacco leaf stems. In addition, homogenized tobacco material may comprise a minor quantity of one or more of tobacco dust, tobacco fines, and other particulate tobacco by-products formed during the treating, handling and shipping of tobacco. The lipid is evenly distributed throughout the homogenised tobacco material, which means that at room temperature there are preferably no separately distinguishable regions of lipid and tobacco. Rather, the lipid and tobacco particles are fully homogenized.

When the homogenized tobacco material is heated to a temperature above the melting point of the lipid, the lipid portion of the homogenized tobacco material melts and the material may then form fine-scale regions of material that are in a liquid state within a solid matrix. The diffusivity of volatile components, such as aerosol-formers and nicotine, is greater in a liquid phase than in a solid phase. After heating, the melted lipid regions may act to facilitate the transfer of volatile components within the homogenized tobacco material to its surface. Therefore, for a given temperature above the melting point of the lipid, the transfer of these volatile components from the homogenized tobacco material to an aerosol may be enhanced in comparison with a homogenized tobacco material that does not contain a lipid phase.

Homogenized tobacco material is one of the most expensive elements of a heated aerosol-generating article. The use of a homogenized tobacco material having a meltable lipid component, as described herein, may allow less tobacco to be used while providing an equivalent nicotine or aerosol yield compared to use of a homogenized tobacco material without a lipid component. This may provide cost savings while still providing a consumer an equivalent experience.

The use of a homogenized tobacco material having a lipid component may also provide an increased nicotine or aerosol yield compared to a homogenized tobacco material having the same amount of tobacco but without a meltable lipid component.

The use of a homogenized tobacco material having a lipid component, as described herein, may allow equivalent nicotine or aerosol yields at a lower temperature compared to the use of a homogenized tobacco material without a lipid component. This may provide a number of benefits. For example, a lower temperature of operation may allow for longer periods of use without the need to recharge a battery. As a further example, a lower temperature of operation may allow for use of a smaller battery. As a further example, a lower temperature of operation may reduce the liberation of undesirable aerosol constituents from the homogenized tobacco material.

By specifying a lipid with a melting point of between 50° C. and 150° C. the homogenized tobacco material is fully solid at ambient temperature or when in contact with the human body. Thus, the homogenized tobacco material may provide sufficient strength at ambient temperature for handling and processing. The homogenized tobacco material may retain its shape and structure when, for example, carried in a user's pocket. On heating during use, however, a portion of the homogenized tobacco material can be melted and the transfer of volatile components may be improved.

Where a heated aerosol-generating article is provided, it may be preferred if the aerosol-forming substrate of the article is in the form of a rod that has been made by crimping and gathering a sheet of homogenized tobacco material. The heated aerosol-generating article may comprise a plurality of components, including the aerosol-forming substrate. These components may be assembled within a wrapper, such as a cigarette paper, to form a rod having a mouth end and a distal end upstream from the mouth end. Thus, the heated aerosol-generating article may resemble a traditional cigarette. The heated aerosol-generating article may comprise one or more other components such as a mouthpiece filter and an aerosol-cooling element.

A heated aerosol-generating article is an article comprising an aerosol-forming substrate that is capable of releasing volatile compounds that can form an aerosol on the application of heat. A heated aerosol-generating article is a non-combustible aerosol-generating article. A non-combustible aerosol-generating article releases volatile compounds without the combustion of the aerosol-forming substrate.

The aerosol-forming substrate is capable of releasing volatile compounds that can form an aerosol volatile compound and may be released by heating the aerosol-forming substrate. In order for the homogenized tobacco material to be used in an aerosol-generating article, aerosol formers are preferably included in the slurry that forms the cast leaf.

The lipid is a wax. Many waxes have melting points within the specified range. Waxes are a group of chemical compounds that are malleable at ambient temperatures, but typically melt at temperatures above 45° C.

The lipid is a wax having a melting point in the range between 50° C. and 150° C. Such waxes will be solid at ambient temperatures, but will melt when heated. Preferably the wax is a natural wax of vegetable origin. An advantage of the use of wax is that the ambient temperature strength and stability of the homogenized tobacco material is likely to be maintained more readily than if the lipid was a fat with a melting point of lower than 50° C.

It may be preferably that the wax has a melting point range in which the lower temperature of the range is as low as possible while still being in excess of 50° C. For example, it may be preferred that the wax has melting point range with a lower temperature of between 50° C. and 100° C., preferably between 55° C. and 80° C., or between 60° C. and 75° C. A lower melting point of the wax may result in increased transfer of volatile components on heating.

The homogenized tobacco material according to any aspect may contain one or more waxes selected from the list consisting of candellila wax, carnauba wax, shellac, sunflower wax, rice bran, and Revel A.

Waxes tend to exhibit a melting temperature range rather than a specific melting point. Example melting temperature ranges for suitable waxes are as follows:

Candelilla wax—Melting point range 68.5-72.5° C.
Carnauba wax—Melting point range 82-86° C.
Shellac—Melting point range 80-100° C.
Sunflower wax—Melting point range 74-77° C.
Rice bran—Melting point range 77-86° C.
Revel A—Melting point approximately 64° C.

The homogenized tobacco material according to any aspect may comprise two or more lipids having differing melting points, or differing melting point ranges. Thus, it may be able to produce a homogenized tobacco material containing regions or phases of two or more lipids that melt or liquefy at differing temperatures. This may allow optimization of the transfer of volatile components between the homogenized tobacco material and an aerosol on heating. For example, the homogenized tobacco material may contain two or more lipids selected from the list consisting of candellila wax, carnauba wax, shellac, sunflower wax, rice bran, and Revel A.

The total content of lipid in the homogenized tobacco material is between 5 weight percent and 15 weight percent on a dry weight basis. For example the total content of lipid in the homogenized tobacco material may be between 7 weight percent and 12 weight percent on a dry weight basis, for example between 8 weight percent and 11 weight percent on a dry weight basis, or about 10 weight percent on a dry weight basis. The total content of lipid may derive from a single species of lipid. The total content of lipid may derive from two or more species of lipid.

The homogenized tobacco material according to any aspect may contain tobacco in the form of a tobacco powder. For example, tobacco material may be ground to form a powder having a specified particle size. Thus, the homogenized tobacco material may contain tobacco powder having a mean powder particle size of between about 0.03 millimeters and about 0.12 millimeters, for example between 0.05 millimeters and about 0.10 millimeters. The tobacco powder may comprise a blend of different tobaccos. It is believed that fine grinding to this fine size range can advantageously open the tobacco cell structure. Thus, the aerosolization of volatile tobacco substances, such as nicotine, from the tobacco itself is improved.

The homogenized tobacco material according to any aspect may comprise an aerosol-former. Functionally, the aerosol-former is a component that can be volatilized and convey nicotine and/or flavouring in an aerosol when the homogenized tobacco material is heated above the specific volatilization temperature of the aerosol-former. An aerosol-former may be any suitable compound or mixture of compounds that, in use, facilitates formation of a dense and stable aerosol and is substantially resistant to thermal degradation at the operating temperature of the heated aerosol-generating article. Different aerosol formers vaporize at different temperatures. Thus, an aerosol-former may be chosen based on its ability to remain stable at or around room temperature but volatize at a higher temperature, for example between 40-450° C.

The aerosol-former may also have humectant type properties that help maintain a desirable level of moisture in the homogenized tobacco material. In particular, some aerosol-formers are hygroscopic materials that function as a humectant.

Suitable aerosol-formers for inclusion in homogenized tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate, dimethyl tetradecanedioate, erythritol, 1,3-butylene glycol, tetraethylene glycol, Triethyl citrate, Propylene carbonate, Ethyl laurate, Triactin, meso-Erythritol, a Diacetin mixture, a Diethyl suberate, triethyl citrate, benzyl benzoate, benzyl phenyl acetate, ethyl vanillate, tributyrin, lauryl acetate, lauric acid, myristic acid, and Propylene Glycol.

For example, where the homogenized tobacco material according to the specification is intended for use as an aerosol-forming substrate in a heated aerosol-generating article, the homogenized tobacco material may have an aerosol-former content of between about 5 percent and about 30 percent by weight on a dry weight basis. Homogenized tobacco material intended for use in electrically-operated aerosol-generating system having a heating element may preferably include an aerosol-former forming between about 5 percent to about 20 percent of dry weight of the homogenized tobacco material, for example between about 10 percent to about 15 percent of dry weight of the homogenized tobacco material. For homogenized tobacco materials intended for use in electrically-operated aerosol-generating system having a heating element, the aerosol former may preferably be glycerol (also known as glycerin or glycerine) or propylene glycol. The aerosol-former may be one or more aerosol-former selected from the list consisting of propylene glycol, triethylene glycol, 1,3-butanediol, glycerine, glycerol monoacetate, glycerol diacetate, glycerol triacetate, dimethyl dodecanedioate, and dimethyl tetradecanedioate.

One or more aerosol former may be combined to take advantage of one or more properties of the combined aerosol formers. For example, Triactin may be combined with glycerine and water to take advantage of the Triactin's ability to convey active components and the humectant properties of the glycerine.

The homogenized tobacco material according to any aspect may contain one or more binder component. There is a practical limit to the amount of binder that may be present in a tobacco slurry and hence in a homogenized tobacco material formed by casting the slurry. This is due to the tendency of the binders to gel when coming in contact with water. Gelling strongly influences the viscosity of the tobacco slurry, which in turn is an important parameter of the slurry for subsequent web manufacturing processes, like for example casting. It is therefore preferred to have a relatively low amount of binder in the homogenized tobacco material. In some embodiments, binder may comprise between about 1 percent and about 5 percent in dry weight of the homogenized tobacco material. The binder may be any of the gums or pectins described herein. The binder may help ensure that tobacco, for example tobacco powder, remains substantially dispersed throughout the homogenized tobacco material.

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. A particularly preferred binder is guar.

A homogenized tobacco material comprising tobacco, a lipid, an aerosol-former, and optionally a binder, may lack the strength required for handling and processing to form an aerosol-forming substrate for a heated aerosol-generating article. This may particularly the case where the homogenized tobacco material contains a high proportion of aerosol-former or a high proportion of lipid on a dry weight basis, where the lipid is of a low melting point, or where the tobacco is in the form of a finely ground powder. In order to achieve a better strength, the homogenized tobacco material may contain one or more further components such as a binder and a reinforcement.

Homogenized tobacco material according to any aspect may comprise reinforcement fibres. The reinforcement fibres may have a mean fibre length of between 0.2 mm and 4.0 mm. The reinforcement fibres may be cellulose fibres. In some embodiments, the homogenized tobacco material may contain between 1 weight percent and 15 weight percent of reinforcement fibres on a dry weight basis, for example between 1.5 weight percent and 10 weight percent of reinforcement fibres on a dry weight basis.

The inclusion of fibres, such as cellulose fibres, in the homogenized tobacco material increases the tensile strength of the material. Therefore, adding reinforcement fibres may increase the resilience of a web of homogenized tobacco material. This supports a smooth manufacturing process and subsequent handling of the homogenized tobacco material during the manufacture of aerosol-generating articles. In turn, this can lead to an increase in production efficiency, cost efficiency, reproducibility and production speed of the manufacture of the aerosol-generating articles and other smoking articles.

Cellulose fibres for inclusion in a homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Fibres particles may include tobacco stem materials, stalks or other tobacco plant material. Preferably, cellulose-based fibres such as wood fibres comprise a low lignin content. Alternatively fibres, such as vegetable fibres, may be used either with the above fibres or in the alternative, including hemp and bamboo.

One relevant factor to be considered for reinforcement fibres is the fibre length. Where the fibres are too short, the fibres would not contribute efficiently to the tensile strength of the resulting homogenized tobacco material. Where the fibres are too long, the fibres may impact the homogeneity of the homogenized tobacco material. The size of fibres in a homogenized tobacco material comprising tobacco powder having a mean size between about 0.03 millimeters and about 0.12 millimeters and a quantity of binder between about 1 percent and about 3 percent in dry weight of the slurry, is advantageously between about 0.2 millimeters and about 4 millimeters. Preferably, the mean size of the fibres is between about 1 millimeter and about 3 millimeters. Preferably, this further reduction is obtained by means of a refining step. In the present specification, the fibre "size" means the fibre length, that is, the fibre length in the dominant dimension of the fibre. Further, preferably, according to the invention, the amount of the fibres is comprised between about 1 percent and about 3 percent in dry weight basis of the total weight of the homogenized tobacco material. Fibres having a mean size between about 0.2 millimeters and about 4 millimeters do not significantly inhibit the release of substances from fine ground tobacco powder when the homogenized tobacco material is used as an aerosol generating substrate of an aerosol generating article. Reinforcement fibres may be introduced into a tobacco slurry, and consequently into the homogenized tobacco material, as loose fibres.

Homogenized tobacco material according to any aspect may comprise reinforcement in the form of a continuous reinforcement incorporated in the homogenized tobacco material. A continuous reinforcement may be incorporated into a tobacco slurry during formation of the homogenized tobacco material. The continuous reinforcement is preferably a porous reinforcement sheet.

The reinforcement sheet should be sufficiently porous for tobacco slurry to permeate into the porous reinforcement sheet before the slurry dries, thereby incorporating the reinforcement sheet into the homogenized tobacco material. Preferably, the porous reinforcement sheet is encapsulated within dried homogenized slurry to form the homogenized tobacco material. The porous reinforcement sheet may alternatively be termed a porous reinforcement matrix. The porous reinforcement sheet may be a porous fibre sheet or a porous fibre matrix, such as a porous cellulose sheet or a paper sheet, or a porous woven fabric.

A porous reinforcement sheet formed from cellulose may be a preferred continuous reinforcement material. However, other materials may be used. For example, the porous reinforcement sheet may be a sheet that can be described as a porous fibre sheet or porous fibre matrix. The fibres of the sheet may be formed from other polymer materials such as polyethylene, polyester, polyphenylene sulphide, or a polyolefin. The fibres may be natural materials such as cotton.

The incorporation of a reinforcement sheet into the homogenized slurry may increase the tensile strength of the resulting homogenized tobacco material sufficiently that the material may be able to comprise a high proportion of the lipid phase. The incorporation of a reinforcement sheet into the homogenized slurry may increase the tensile strength of the resulting homogenized tobacco material sufficiently that the material may be able to comprise a lipid phase with a low melting point.

The homogenized tobacco material according to any aspect may comprise water. The homogenized tobacco material according to any aspect may comprise non-tobacco flavourants such as menthol.

A method of forming homogenized tobacco material according to any aspect described above may comprise steps of, forming a homogenized slurry comprising tobacco, for example tobacco powder, and a powdered lipid having a melting point between 50° C. and 150° C., casting the homogenized slurry onto a moving belt, and drying the cast homogenized slurry to form the homogenized tobacco material. The powdered lipid is a powdered wax. The homogenized slurry may further comprise an aerosol-former. The homogenized slurry may further comprise reinforcement fibres. A continuous reinforcement sheet may be incorporated into the homogenized slurry prior to the slurry being dried. The homogenized slurry may further comprise a binder. The homogenized slurry may additionally comprise water.

The slurry may be heated to a temperature above the melting point of the lipid, and then cooled to below the melting point of the lipid before the slurry is cast. This may help to distribute the lipid evenly within the homogenized tobacco material.

The homogenized slurry is produced by mixing the various components of the slurry. It is preferred that mixing of the slurry is performed using a high energy mixer or a high shear mixer. Such mixing breaks down and distributes the various phases of the slurry evenly.

In some embodiments, a slurry may be formed by combining a tobacco blend powder of different tobacco types with a binder. Thus, the flavour of the homogenized tobacco material may be controlled by blending different tobaccos.

If a binder is used, the binder is preferably added into the slurry in an amount between about 1 percent and about 5 percent in dry weight basis of the total weight of the slurry. The resultant homogenized tobacco material comprises an extrinsic binder in an amount between about 1 percent and about 5 percent in dry weight basis of the total weight of the homogenized tobacco material.

The method may comprise the step of vibrating the slurry. Vibrating the slurry, that is for example vibrating a tank or silo where the slurry is present, may help the homogenization of the slurry. Less mixing time may be required to homogenize the slurry to the target value optimal for casting is together with mixing also vibrating is performed.

A web of homogenized tobacco material is preferably formed by a casting process of the type generally comprising casting the homogenous slurry on a moving support surface such as a moving belt. Preferably, the moisture of said cast tobacco material web at casting is between about 60 percent and about 80 percent of the total weight of the tobacco material at casting. Preferably, the method for production of a homogenized tobacco material comprises the step of drying said cast web, winding said cast web, wherein the moisture of said cast web at winding is between about 7 percent and about 15 percent of dry weight of the tobacco material web. Preferably, the moisture of said homogenized tobacco web at winding is between about 8 percent and about 12 percent of dry weight of the homogenized tobacco web.

The invention will be further described, by way of example only, with reference to the accompanying drawing in which:

FIG. 1 shows a flow diagram of a method to produce an homogenized tobacco material according to a specific embodiment of the invention.

In a typical prior art process for manufacturing a web of reconstituted tobacco material, tobacco powder or dust is combined with cellulose fibres, a binder, and water to form a slurry. The slurry is then cast onto a moving belt and the slurry is dried to form the web of material. Such methods are well known to the skilled person. The slurry may further include other components, for example aerosol-formers such as glycerine. The cellulose fibres and the binder impart strength to the resulting homogenized tobacco material. A web intended for use as an aerosol-forming substrate in a heated aerosol-generating article may have a specific blend of tobacco and may have a high proportion of aerosol-former. As such, the web may have a low intrinsic strength. The strength of such a web may be increased by increasing the amount of cellulose fibre and binder.

FIG. 1 is a flow diagram illustrating a general method for the production of homogenized tobacco material according to a specific embodiment of the present invention. The first step of the method is the selection 101 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

Further, the method includes a step 102 of coarse grinding of the tobacco leaves.

After the coarse grinding step 102, a fine grinding step 103 is performed. The fine grinding step reduces the tobacco powder mean size to between about 0.03 millimeters and about 0.12. This fine grinding step 103 reduces the size of the tobacco down to a powder size suitable for the slurry preparation. After this fine grinding step 103, the cells of the tobacco are at least partially destroyed and the tobacco powder may become sticky.

The lipid may be incorporated into the slurry as a solid phase or as a liquid phase. It may be preferred to add the lipid to the slurry in the form of solid particles. The slurry may then be heated to above the melting point of the lipid after slurry formation, and prior to casting, to distribute the lipid evenly throughout the slurry. If the slurry is heated to above the melting point of the lipid, it is preferable that it is cooled to a temperature of about 40° C. prior to casting and drying.

Thus, the ground tobacco powder may be mixed with a powdered lipid, an aerosol-former, a binder, and water to form a slurry 104. The lipid is preferably one or more wax selected from the list consisting of candellila wax, carnauba wax, shellac, sunflower wax, rice bran, and Revel A. Preferably, the aerosol-former comprises glycerine, and preferably the binder comprises guar.

Preferably, the step of slurry formation 104 also comprises a mixing step, where all the slurry ingredients are mixed together for a fixed amount of time. The mixing step uses a high shear mixer. The slurry is then cast 105 onto a moving support, such as a steel conveyor belt. The slurry is preferably cast by means of a casting blade. The cast slurry is then dried 106 to form the homogenized tobacco web. The drying step 106 includes drying the cast web by means of steam and heated air. Preferably the drying with steam is performed on the side of the cast web in contact with the support, while the drying with heated air is performed on the free side of the cast web.

Preferably, at the end of the drying step 106, the homogenized tobacco web is removed from the support 107. The homogenized tobacco web is preferably wound in one or more bobbins in a winding step 108, for example to form a single master bobbin. This master bobbin may be then used to perform the production of smaller bobbins by slitting and small bobbin forming process. The smaller bobbin may then be used for the production of an aerosol-generating article (not shown).

The web of homogenized tobacco material may be used to form aerosol-forming substrates for use in aerosol-generating articles. For example, a sheet of the homogenized tobacco material may be gathered to form a rod of aerosol-forming substrate for use in a heated aerosol-generating article.

Experiment 1—Homogenized Tobacco Materials Comprising Waxes

In order to evaluate improvements in transfer of volatile components resulting from the incorporation of a lipid component into a homogenized tobacco material, a number of homogenized tobacco materials containing different high melting point lipids were formed and compared with a control homogenized tobacco material not containing a lipid.

The control homogenized tobacco material comprised 65 wt % of tobacco powder, 20 wt % glycerine, 10 wt % water, 3 wt % guar, and 2 wt % cellulose fibres as reinforcement. The control homogenized tobacco material was formed by mixing the constituents into a slurry, casting the slurry and drying the slurry.

A test material was formed using identical components to the control material, but varying the proportions of aerosol-former and tobacco powder, and including a proportion of candellila wax. Other constituents of the homogenized tobacco material remain unchanged. Thus, a first homogenized tobacco material was formed comprising 63 wt % of tobacco powder, 12 wt % of a lipid in the form of candellila wax, and 10 wt % of an aerosol-former in the form of glycerine was formed. Candellila wax has a chemical abstracts service (CAS) number of CAS 8006-44-8 and a melting point of between 68.5-72.5° C.

The homogenized tobacco material comprising candellila wax was formed as described above. Specifically, the candellila wax was mixed with the tobacco powder, the guar binder, the water, the cellulose fibres and the glycerine and mixed to form a slurry. The slurry was then heated to a temperature of 75° C., i.e. above the melting point of the candellila wax, and mixed to form a homogenized slurry. The slurry was then cooled to a temperature of 40° C., cast and dried to form a sheet of homogenized tobacco material.

Further test materials were formed in almost identical fashion comprising Revel A (CAS 68956-68-3), carnauba wax (CAS 8015-86-9), and rice bran (CAS 8016-60-2) instead of candellila wax. In each case the slurry was heated to, and mixed at, a temperature slightly above the melting point of the wax. For example, for production of the Revel A sample the slurry was heated to 65° C. for mixing and then cooled to 40° C. for casting.

Heated aerosol-generating articles were formed using each of the control homogenized tobacco material (control article) and the four different test homogenized tobacco materials (test articles A, B, C, and D). Each of these different heated aerosol-generating articles was smoked under Health Canada conditions and the transfer rate of nicotine and glycerine was determined. Glycerine levels were determined according to CORESTA recommended method No. 60. Nicotine levels were determined according to ISO10315. Transfer rate was defined as (amount of substance delivered in aerosol)/(amount of substance present in the homogenized tobacco material). Transfer rate may alternately be designated transfer efficiency. The results are shown in the table below.

| | Transfer Rate Glycerine | Transfer Rate Nicotine |
|---|---|---|
| Control article - homogenized tobacco material comprises 20% Glycerine and 65% Tobacco | 5.01% | 18.05% |
| Test article A - homogenized tobacco material comprises 10% Glycerine, 12% candellila wax, and 63% Tobacco | 7.52% | 21.91% |
| Test article B - homogenized tobacco material comprises 10% Glycerine, 12% Revel A, and 63% Tobacco | 7.79% | 21.87% |
| Test article C - homogenized tobacco material comprises 10% Glycerine, 12% carnauba wax, and 63% Tobacco | 7.49% | 21.73% |
| Test article D - homogenized tobacco material comprises 10% Glycerine, 12% rice bran, and 63% Tobacco | 6.67% | 20.47% |

It can be clearly seen that, under identical smoking conditions, homogenized tobacco materials having a lipid component produced a higher rate of glycerine transfer and a higher rate of nicotine transfer than a control homogenized tobacco material lacking a lipid component.

The invention claimed is:

1. A heated aerosol-generating article for producing an inhalable aerosol, the heated aerosol-generating article comprising:

an aerosol-forming substrate that is a homogenized tobacco material comprising tobacco and a wax having a melting point between 50° C. and 150° C., wherein a total content of wax in the homogenized tobacco material is between 5 weight percent and 15 weight percent on a dry weight basis, and wherein the wax is evenly distributed within the homogenized tobacco material.

2. The heated aerosol-generating article according to claim 1, wherein the homogenized tobacco material contains one or more waxes selected from the group consisting of candellila wax, carnuba wax, shellac, sunflower wax, rice bran, and Revel A.

3. The heated aerosol-generating article according to claim 1, wherein the homogenized tobacco material is tobacco powder having a mean particle size of between 0.03 mm and 0.12 mm.

4. The heated aerosol-generating article according to claim 1, further comprising one or more aerosol-formers.

5. The heated aerosol-generating article according to claim 4, wherein the one or more aerosol-formers is selected from the group consisting of propylene glycol, triethylene glycol, 1,3-butanediol, glycerine, glycerol monoacetate, glycerol diacetate, glycerol triacetate, dimethyl dodecanedioate, and dimethyl tetradecanedioate.

6. The heated aerosol-generating article according to claim 4, wherein a total content of the one or more aerosol-formers in the homogenized tobacco material is between 5 weight percent and 20 weight percent on a dry weight basis.

7. The heated aerosol-generating article according to claim 1, wherein the aerosol-forming substrate is a rod formed from a gathered sheet of the homogenized tobacco material.

8. The heated aerosol-generating article according to claim 1, further comprising reinforcement fibres.

9. The heated aerosol-generating article according to claim 8, wherein the reinforcement fibres have a mean fibre length of between 0.2 mm and 4.0 mm.

10. The heated aerosol-generating article according to claim 8, wherein the homogenized tobacco material contains between 1 weight percent and 10 weight percent of the reinforcement fibres on a dry weight basis.

11. A homogenized tobacco material for an aerosol-forming substrate in a heated aerosol-generating article according to claim 1, wherein the homogenized tobacco material comprises tobacco and a wax having a melting point between 50° C. and 150° C., wherein a total content of wax in the homogenized tobacco material is between 5 weight percent and 15 weight percent on a dry weight basis, and wherein the wax is evenly distributed within the homogenized tobacco material.

12. A method of making a homogenised tobacco material according to claim 11, comprising steps of:

forming a slurry comprising tobacco, powdered wax, and water;

homogenizing the slurry; and casting and drying the slurry to form the homogenized tobacco material, wherein the powdered wax has a melting point of between 50° C. and 150° C.

13. The method according to claim 12, wherein the slurry is heated to a temperature above the melting point of the wax, and then cooled to below the melting point of the wax before the slurry is cast.

* * * * *